US006863588B1

(12) United States Patent
Chu

(10) Patent No.: US 6,863,588 B1
(45) Date of Patent: Mar. 8, 2005

(54) COLLAPSIBLE THROWING TOY AND ITS ASSOCIATED METHOD OF MANUFACTURE

(76) Inventor: Kwong Wing Chu, Ma On Shan, Shatin, New Territories, Hong Kong (CN)

( * ) Notice: Subject to any disclaimer, the term of this patent is extended or adjusted under 35 U.S.C. 154(b) by 0 days.

(21) Appl. No.: 10/724,420

(22) Filed: Dec. 1, 2003

(51) Int. Cl.[7] ..... A63H 33/00; A63B 65/10

(52) U.S. Cl. ..... 446/487; 446/46; 473/588; 473/572; 473/593

(58) Field of Search ..... 446/487, 46, 71, 446/486; 473/588, 572, 593, 573, 595, 612

(56) References Cited

U.S. PATENT DOCUMENTS 2,952,460 A * 9/1960 Ellis ..... 473/609
2,968,121 A * 1/1961 Pearson, Jr. et al. ..... 446/177
3,218,071 A * 11/1965 Richard ..... 473/594
4,955,841 A * 9/1990 Pastrano ..... 446/46
5,096,751 A * 3/1992 Duchek ..... 428/12
5,797,815 A 8/1998 Goldman et al. ..... 473/588
D434,457 S 11/2000 Goklman et al. ..... D21/440

* cited by examiner

*Primary Examiner*—Bena B. Miller
(74) *Attorney, Agent, or Firm*—LaMorte & Associates

(57) ABSTRACT

A toy assembly and its method of manufacture. The toy assembly is a spherical object that can be temporarily compressed into a disc. A short time after compression, the toy pops back into its original ball-like shape. The toy assembly has shell sections that join along at least one joint line to form a generally spherical body. The shell sections are symmetrically disposed around a central axis. The spherical body is bisected by an imaginary equatorial plane that is perpendicular to the central axis. The joint lines between shell sections exist in meridian planes that are perpendicular to the equatorial plane. A connector mechanism is provided that temporarily connect opposite sides of the shell when the shell is compressed. The shell sections provide a spring bias that resists any compression and causes the shell sections to return to a spherical shape when the connector mechanism release.

19 Claims, 4 Drawing Sheets

COLLAPSIBLE THROWING TOY AND ITS ASSOCIATED METHOD OF MANUFACTURE

BACKGROUND OF THE INVENTION

1. Field of the Invention

In general, the present invention relates to toy objects that are spring biased in an expanded configuration, yet can be temporarily configured into a collapsed configuration. More particularly, the present invention relates to thrown toy objects, such as balls, that can be temporarily pressed into a collapsed configuration, wherein the thrown toy pops back into an expanded configuration a short time later. The present invention also relates to the method of manufacturing such toy objects.

2. Description of the Prior Art

The prior art is replete with various types of toys that are intended to be thrown. Prominent among such toys are balls and discs. It therefore is not surprising that toy manufacturers eventually combined the features of a ball and a disc into a single throwing toy.

It is for this reason that collapsible ball throwing toys were first introduced into the toy market. Collapsible ball throwing toys are balls, or similar spherically shaped objects, that are comprised of an upper hemisphere and a lower hemisphere. The upper hemisphere and the lower hemisphere are joined together with hinged connections along a common equatorial joint. Due to the hinged connections between the upper hemisphere and the lower hemisphere, the upper and lower hemispheres of the ball can be collapsed flat against each other. When the upper and the lower hemispheres of the toy are collapsed against each other, the toy has the general configuration of a disc. Accordingly, the collapsible ball throwing toy can be configured as either a ball or as a disc, depending upon whether or not the toy is compressed.

As the upper and lower hemispheres of the toy are collapsed into a flat configuration, the diameters of the hemispheres expand. To accommodate this expansion, the upper and lower hemispheres of the toy are slotted. When the toy is fully expanded into its ball shape, the slots are closed and the toy has a continuous external surface. However, when the toy is flattened into a disc, the slots open and expand, giving the disc a daisy configuration. A typical daisy configuration of a collapsible ball throwing toy can be seen by referencing U.S. Pat. No. Des 434,457 to Goldman, entitled Collapsible Toy.

In the prior art, collapsible ball throwing toys typically have some sort of biasing element that biases the collapsible ball throwing toy into its expanded, ball-like configuration. For example, in U.S. Pat. No. 5,797,815 to Goldman, entitled Pop-Open Throwing Toy With Controllable Opening Delay And Method Of Operating Same, a collapsible ball throwing toy is shown that has an internal coil spring. The coil spring biases apart the upper and lower hemispheres of the toy. The collapsible ball throwing toy can be temporarily configured like a disc by compressing the internal coil spring and resisting the bias of the coil spring with a momentary suction cup connection between the upper and lower hemispheres. As soon as the momentary suction cup connection fails, the internal coil spring pops the collapsible ball throwing toy back into its expanded ball-like configuration.

In U.S. Pat. No. 4,955,841 to Pastrano, entitled Disc-Shaped Throwing Toy, a collapsible ball throwing toy is disclosed. The collapsible ball throwing toy is shaped like a polyhedron. The collapsible ball throwing toy has an upper and lower hemisphere joined with a hinged connection along an equatorial joint. When compressed, the hemispheres flatten along lines in the polyhedral pattern and expand at the equatorial joint. Due to the hinged connection at the equatorial joint, the upper and lower hemispheres can fold flat against each other. However, once a compressing force is removed, the memory of the material used to make the polyhedral configuration causes both hemispheres to slowly return to their expanded shapes. As such, the collapsible ball throwing device can be flattened and thrown. After being thrown, the collapsible ball throwing device slowly returns to its expanded spherical shape. This prior art design, therefore, lacks the desired sudden transition between its collapsed condition and its expanded condition that other prior art versions of the collapsible ball throwing toy embody.

In the manufacturing of prior art collapsible ball throwing toys, one of the controlling costs is how to form the biasing mechanism that biases the toy into its expanded form. If a coil spring is used, there is the cost of the coil spring and the configurations needed to retain the coil spring. If the shell of the collapsible ball throwing toy is used as the biasing mechanism, a complicated shell configuration must be used that greatly increases the costs involved in tooling and assembling the toy. Furthermore, it is desirable that the collapsible ball throwing toy suddenly pop between its flat configuration and its expanded configuration. The collapsible ball throwing toy must therefore have a strong biasing mechanism and an equally strong temporary connecting mechanism that temporarily resists the biasing mechanism. Such connecting mechanisms also add significantly to the cost of manufacture.

A need therefore exists for a collapsible ball throwing toy that can be simplified in its construction so that it can be manufactured less expensively and operate better than prior art configurations. This need is met by the present invention as described and claimed below.

SUMMARY OF THE INVENTION

The present invention is a toy assembly and its method of manufacture. The toy assembly is a ball or similar object that can be temporarily compressed into a disc-shaped object. A short time after compression, the toy pops back into its original ball-like shape.

The toy assembly has a plurality of shell sections that join along at least one joint line to form a generally spherical body. The shell sections are symmetrically disposed around a central axis. The spherical body is bisected by an imaginary equatorial plane that is perpendicular to the central axis. The joint lines between shell sections exist in meridian planes that are perpendicular to the equatorial plane.

A connector mechanism is provided that has two opposing components that temporarily connect when brought into abutment. The opposing components are disposed within the spherical body in line with the central axis. The shell sections used in the toy are flexible and enable the spherical body of the toy to be compressed into a non-spherical shape. When in this non-spherical shape, the opposing components of the connector mechanism abut and temporarily connect. The shell sections provide a spring bias that resists compression and causes the shell sections to return to a spherical shape when the opposing components of the connector mechanism release. The toy therefore pops back into its spherical shape after remaining compressed for a period of time.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
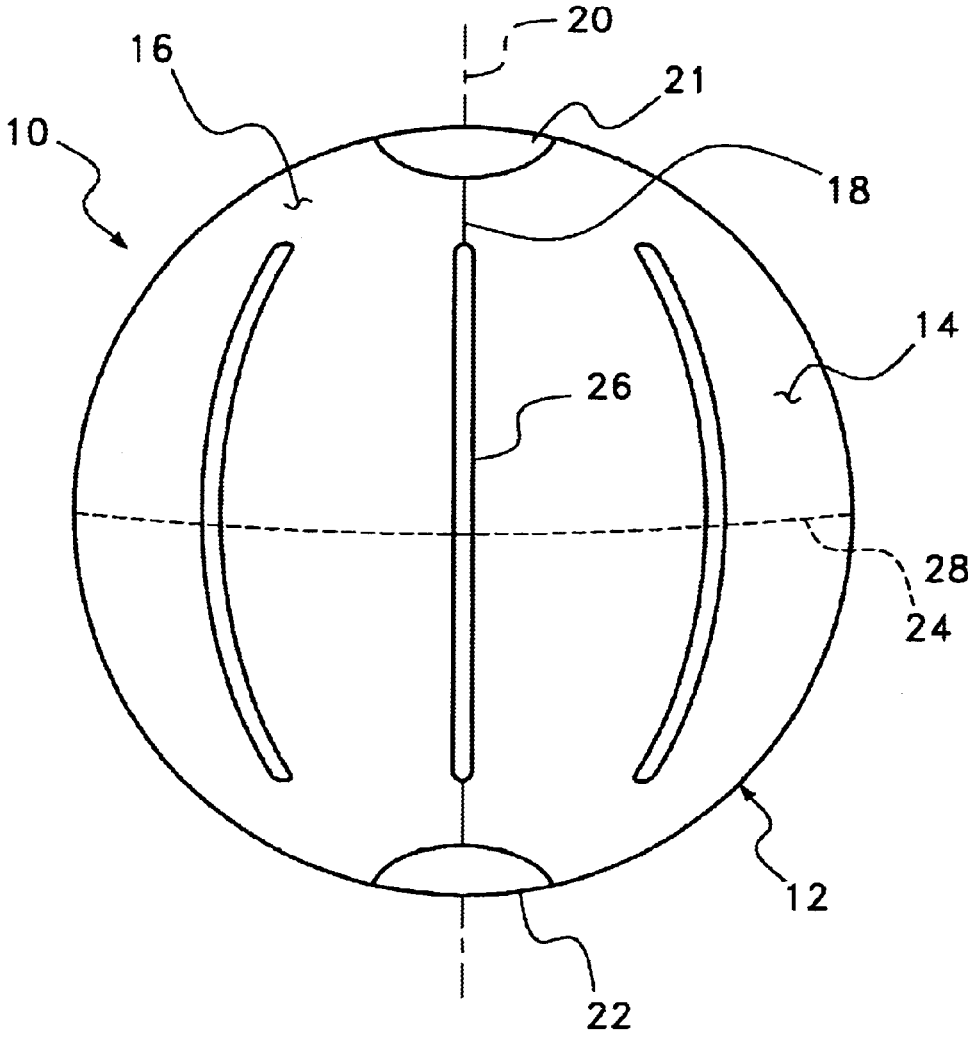
FIG. 1 is a perspective view of an exemplary embodiment of the present invention shown in its expanded condition.

The present invention is a collapsible ball throwing toy and its associated method of manufacture. Referring to FIG. 1, an exemplary embodiment of a collapsible ball throwing toy 10 is shown. The collapsible ball throwing toy 10 has a spherical body 12 that is made from two molded hemispherical sections 14, 16. Both of the two hemispherical sections 14, 16 are partially joined together along a common joint 18.

The spherical body 12 is symmetrically disposed around a central axis 20. The common joint 18 runs as a meridian line relative the central axis 20, wherein the central axis and the common joint 18 exist in a common plane.

Two end hub assemblies 21, 22 are provided. The end hub assemblies 21, 22 are disposed at opposite ends of the spherical body 12, but both end hub assemblies are positioned along the central axis 20 of the collapsible ball throwing toy 10. As such, the common joint 18 between the two hemispherical sections 14, 16 of the spherical body 12 intersects both end hub assemblies 21, 22 as the joint line 18 encircles the spherical body 12.

If the end hub assemblies 21, 22 are considered to be positioned along the same central axis 20 at different pole ends of the spherical body 12, an imaginary equatorial plane 24 exists between the end hub assemblies 21, 22. The equatorial plane 24 bisects the spherical body 12. Accordingly, the common joint 18 that connects the two hemispherical sections 14, 16 extends in a meridian plane that is perpendicular to the equatorial plane 24.

As will later be more fully described, a mechanical connector, such as a suction cup, is disposed inside the spherical body 12 of the collapsible ball throwing toy 10 behind one of the end hub assemblies 21. A surface that can be temporarily engaged by the mechanical connector is disposed inside the spherical body 12 of the collapsible ball throwing toy 10 behind the opposite end hub assembly 22.

The hemispherical sections 14, 16 that form the spherical body 12 of the collapsible ball throwing toy 10 are made from flexible, yet resilient plastic. Each of the hemispherical sections 14, 16 is molded as a unistructural plastic piece, having no prefabricated folding lines or joints. Slots 26 are symmetrically formed in each of the hemispherical sections 14, 16. The slots 26 extend in straight meridian lines from one end hub assembly toward the other. However, each of the slots 26 has an arcuate length that is less than half of the circumference of the spherical body 12. As such, each slot 26 terminates at an end prior to reaching one of the end hub assemblies 21, 22. Each of the slots 26 also extends in a meridian plane that is perpendicular to the imaginary equatorial plane 24 of the spherical body 12.

Slots 28 also exist between the hemispherical sections 14, 16 along the meridian of the common joint 18. As such, it will be understood that only small sections of the two hemispherical sections 14, 16 are physically joined together along the common joint 18.

Figure 2:
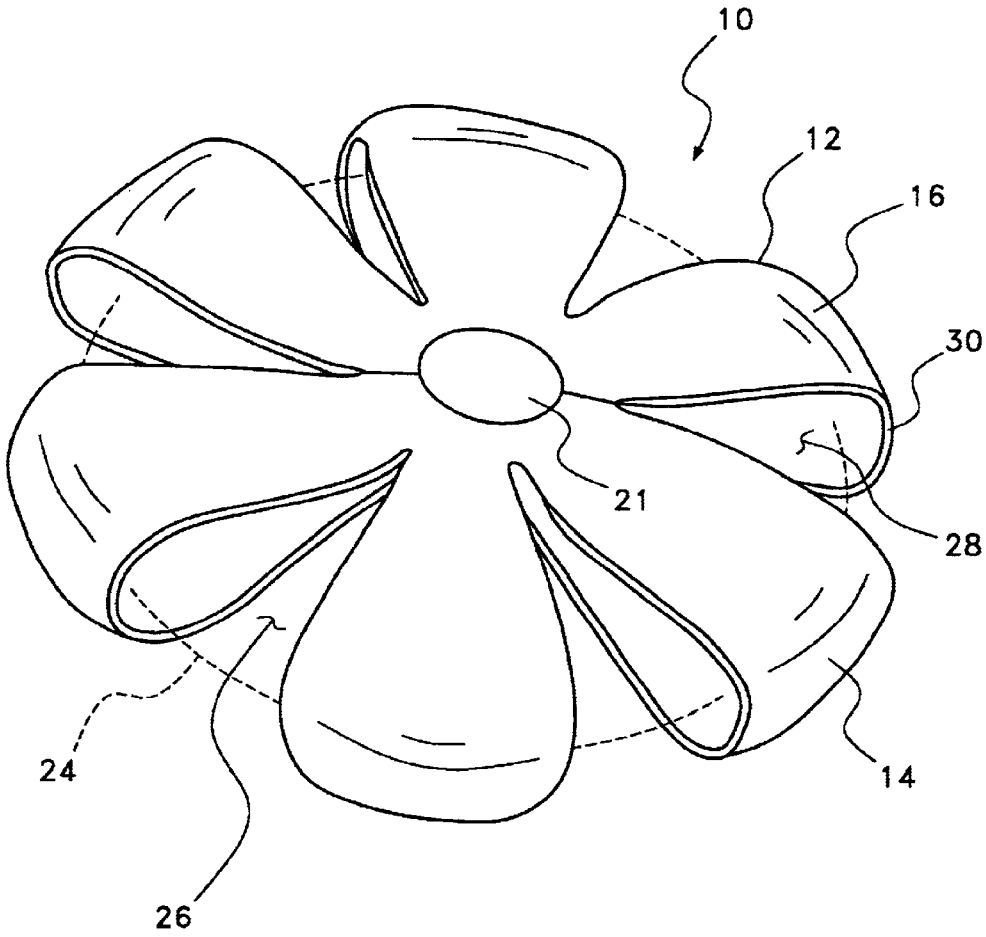
FIG. 2 is a perspective view of the embodiment of FIG. 1 shown in its compressed condition.

Referring to FIG. 2 in conjunction with FIG. 1, it can be seen that the spherical body 12 of the collapsible ball throwing toy 10 can be altered into a disc shape by pressing the two end hub assemblies 21, 22 toward each other. The two end hub assemblies 21, 22 meet at the imaginary equatorial plane 24 of the spherical body 12. As the two end hub assemblies 21, 22 approach one another, the mechanical connector behind one end hub assembly 21 temporally engages a structure under the opposing end hub assembly 22. As the two hemispherical section 14, 16 are compressed, they each bend and spread at the slots 26, 28. However, there is no hinged joint where the equatorial plane 24 passes through the hemispherical sections 14, 16. Rather, each of the hemispherical sections 14, 16 produces a wide, curing bend 30 in the equatorial plane 24. The wide bend 30 creates a spring bias in each of the hemispherical sections 14, 16 that opposes the compression. This spring bias causes the two hemispherical sections 14, 16 to immediately pop back into a spherical shape the instant the compression force is released or the two end hub assemblies 21, 22 release their interconnection. As such, the hemispherical sections 14, 16 themselves act as spring biasing mechanisms that bias the collapsible ball throwing device 10 into a ball-like shape.

Figure 3:
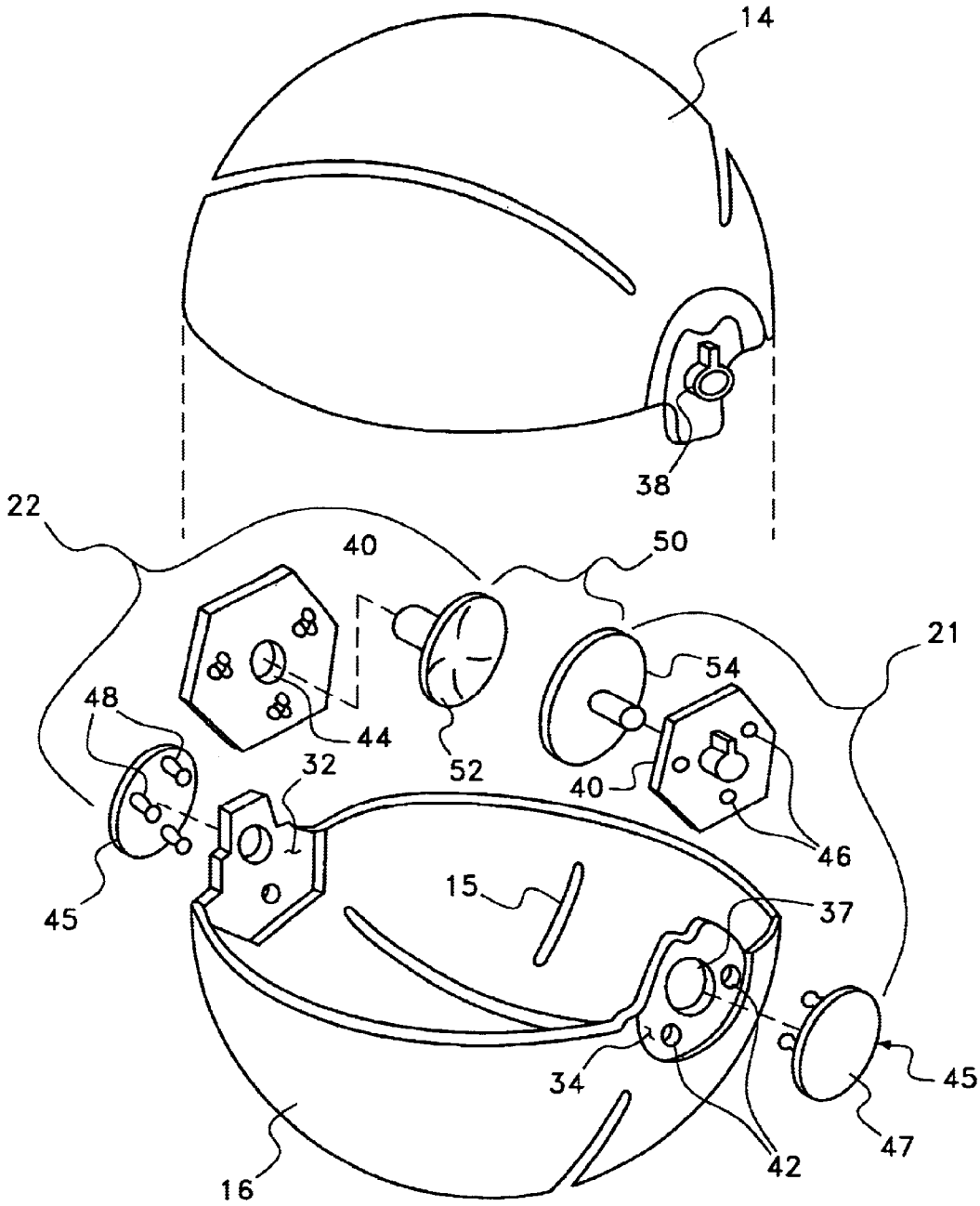
FIG. 3 is an exploded perspective view of the embodiment of the invention shown in FIG. 1 and FIG. 2.

Referring to FIG. 3, it can be seen that each of the hemispherical sections 14, 16 is a plastic molded element that is unistructural in its construction. Preferably, both of the hemispherical sections 14, 16 are identical in construction. As such, only a single plastic injection mold needs to be created to form both of the hemispherical sections 14, 16.

Depressions 15 are formed along the interior of each of the hemispherical sections 14, 16. The depressions do no extend through the hemispherical sections 14, 16 but merely represent places where the wall thickness of the hemispherical sections 14, 16 are thinned. The depressions 15 fall along the line of the equatorial plane 24 (FIG. 2) and help the hemispherical sections 14, 16 bend along the equatorial plane without creasing, as was shown in FIG. 2.

Interior recesses 32 and exterior recesses 34 are formed at the ends of each of the hemispherical sections 14, 16. The recesses 32, 34 serve two purposes. First, the recesses 32, 34 leave room for the end hub assemblies 21, 22 so that the end hub assemblies 21, 22 need not protrude. Second, the recesses 32, 34 help to interconnect the two hemispherical sections 14, 16, as will be explained.

On one side of each hemispherical section 14, 16 a large opening 37 is present through the material that extends from the interior recess 32 to the exterior recess 34. On the opposite end of each hemispherical section 14, 16, a cylindrical protrusion 38 extends outwardly from the exterior recess 34. The two hemispherical sections 14, 16 are joined together in opposite orientations. As such, the cylindrical protrusion 38 of one hemispherical section 16, can pass into the opening 37 on the opposite hemispherical section 14, therein mechanically interlocking the two hemispherical sections 14, 16 together.

Within the region of the recesses 32, 34 at either end of the spherical body 12 are also defined a first plurality of mounting holes 42. The first plurality of mounting holes 42 are used to interconnect the end hub assemblies 21, 22 with the hemispherical sections 14, 16, as is described below.

Each end hub assembly 21, 22 includes a base plate 40 that mounts inside the spherical body 12 created by the two hemispherical sections 14, 16. The base plate 40 rests within an interior recess 32 of the hemispherical sections 14, 16 on either side of the spherical body 12. The interior recesses 32 and the base plates 40 are both preferably complimentarily shaped so that the interior recesses 32 receive the base plates 40 and prevent the base plates 40 from rotating.

Each base plate 40 defines a central opening 44 and a second plurality of mounting holes 46. The central opening 44 is coaxial with the cylindrical protrusion 38 and the opening 37 in the hemispherical sections 14, 16. The second plurality of mounting holes 46 in the base plate 40 align with the first plurality of mounting holes 42 in the hemispherical sections 14, 16. As such, by shaping the internal recess 32 and the periphery of the base plate 40, the mounting holes 46 in the base plate 40 will automatically align with the mounting holes 42 in the hemispherical sections 14, 16 by placing the base plates 40 into the interior recesses 32.

Figure 4:
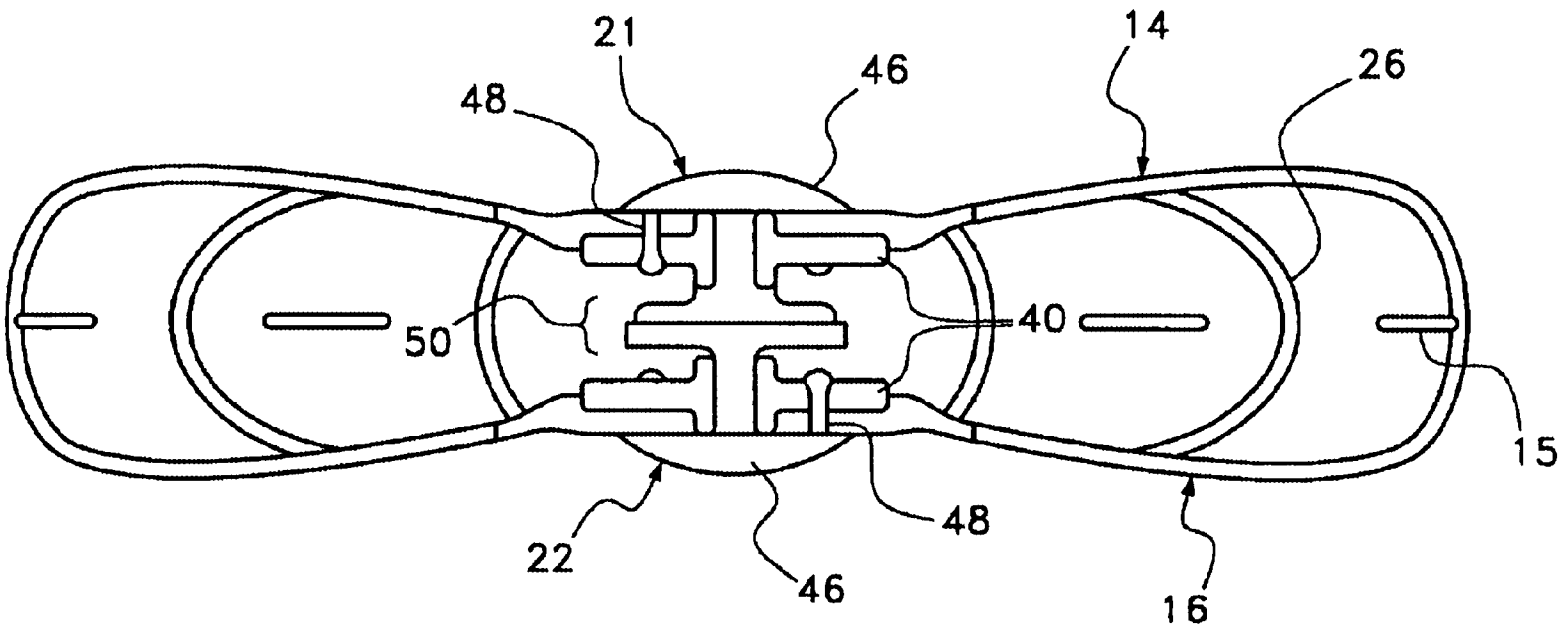
FIG. 4 is a cross-sectional view of the exemplary embodiment.

The base plates 40 are held into place by hubs 45. Each hub 45 has a smooth convex exterior 47 that matches the radius of curvature of the hemispherical sections 14, 16. Locking fingers 48 extend from the hub 45. Referring to FIG. 4 in conjunction with FIG. 3, it can be seen that the locking fingers 48 from the hub 45 extend through the mounting holes 42 (FIG. 3) in the hemispherical sections 14, 16 and the mounting holes 46 in the base plate 40. The mounting holes 46 in the base plate 40 and the locking fingers 48 are configured to mechanically engage each other. As such, once the locking fingers 48 are pushed through the mounting holes 46 in the base plate 40, the locking fingers-48 engage the base plate 40 and cannot be non-destructively removed.

Each base plate 40 defines a central opening 44 (FIG. 3). These openings 44 receive part of a mechanical connector 50. In the shown embodiment, the mechanical connector 50 includes a suction cup 52. One of the mounting plates 40 will receive and retain a suction cup 52. The mounting plate 40 on the opposite side of the toy will receive a plate element 54 that can be engaged by the suction cup 52. As such, when the end hub assemblies 21, 22 are pressed together, the suction cup 52 from one hub assembly will engage the plate element 54 of the second end hub assembly and the two end hub assemblies 21, 22 will remain interconnected for a short period of time.

The suction cup 52 and plate element 54 can be glued in place. However, to help these compoenets from disconnecting from the hub assemblies 21, 22, small pins or other mechanical connecting structures can be used to secure the suction cup 52 and the plate element 54 to the hub assemblies 21, 22.

What resists the interconnection between the cup 52 and the suction plate element 54 is the spring bias created by the deformation of the two hemispherical sections 14, 16. Referring now solely to FIG. 4, it can be seen that when the two end hub assemblies 21, 22 engage each other, the hemispherical sections 14, 16, bend between the slots 26, 28. There is no hinge point along the length of either hemispherical section 14, 16. As such, each hemispherical section 14, 16 acts as a spring and stores potential energy as it bends. The spring bias acts to pull the two end hub assemblies 21, 22 away from each other so that that the hemispherical sections 14, 16 can return to their original combined ball-like shape. The depressions 15 formed in the hemispherical sections 14, 16 help the hemispherical sections 14, 16 to bend evenly without creasing.

The spring bias created by the bent hemispherical sections 14, 16 acts to pull the two end hub assemblies 21, 22 apart. This spring bias force eventually causes the suction cup 52 to pull away from the plate element 54. As soon as this occurs, the spring bias in the hemispherical sections 14, 16 cause the collapsible ball throwing toy 10 to instantly pop back into its ball-like shape.

By providing no hinged connections in between the opposing end hub assemblies 21, 22, the hemispherical sections 14, 16 can provide a spring bias force that was previously only achievable through the use of an auxiliary coil spring. Since the spring bias is now inherent in the structure of the hemispherical sections 14, 16, no auxiliary spring is needed. Additionally, the spherical body 12 of the present invention collapsible ball throwing toy 10 is formed from identical molded shell sections. Furthermore, the hub assemblies used to hold the shell sections together also share identical components and can be assembled without the use of heat bonding, adhesives or any other secondary procedures. The present invention collapsible ball throwing toy 10 can therefore be manufactured with less parts and at a much lower cost than prior art products in the same category.

It will be understood that the embodiments of the present invention collapsible ball throwing toy that is described and illustrated herein are merely exemplary and a person skilled in the art can make many variations to the embodiment shown without departing from the scope of the present invention. For example, the suction based mechanical connector 50 that is used to interconnect the end hub assemblies 21, 22 can be varied. Alternate connectors, such as Velcro, can be use in place of the suction cup, provided the connector provides a temporary interconnection after the toy is compressed. Furthermore, there are many ways that the end hub assemblies can be configured. The design described for the end hub assemblies is merely exemplary. Other configurations can be used provided the end hub assemblies provide the described function of holding the hemispherical sections together and providing a temporary interconnection when compressed.

In the described embodiment, two hemispherical sections 14, 16 are used to form the spherical body 12 of the toy. In alternate embodiments, more than two shell sections can be used. Any plurality of shell sections can be used in forming the present invention provided that the shell sections join along meridian lines in planes that are perpendicular to the equatorial plane of the toy. In this manner, each section will resiliently bend when the toy is compressed and will provide a spring bias that acts to return the toy to its original ball-like shape. All such variations, modifications and alternate embodiments are intended to be included within the scope of the present invention as defined by the appended claims.

What is claimed is:

1. A toy assembly, comprising:

a plurality of shell sections that join along at least one joint line to form a generally spherical body, said shell sections being symmetrically disposed around a central axis, wherein said spherical body is bisected by an imaginary equatorial plane that is perpendicular to said central axis, and wherein said at least one joint line is in a plane that is perpendicular to said equatorial plane;

a connector mechanism having two components that temporarily connect when brought into abutment, each of said components being disposed along said central axis on opposite sides of said spherical body;

wherein said shell sections are flexible and enable said spherical body to be compressed into a non-spherical shape so that said components of said connector mechanism abut and temporarily connect, said shell sections providing a spring bias that resists compression and causes said shell sections to return to a generally spherical shape when said components of said connector mechanism disconnect.

2. The assembly according to claim 1, wherein each of said shell sections is identical in shape.

3. The assembly according to claim 1, wherein said plurality of shell sections includes two generally hemispherical shell sections that join along a common joint line.

4. The assembly according to claim 3, wherein each of said shell sections defines at least one slot, wherein said at least one slot is in a plane perpendicular to said equatorial plane.

5. The assembly according to claim 1, further including two end hubs disposed on opposite ends of said spherical body along said central axis, wherein said end hubs engage each of said shell sections and help retain said shell sections to form said spherical body.

6. The assembly according to claim 5, wherein said end hubs support said components of said connector mechanism within said spherical body.

7. The assembly according to claim 1, wherein each of said shell sections is a unistructurally molded plastic piece.

8. The assembly according to claim 1, wherein said components of said connector mechanism include a suction cup and a suction cup plate.

9. A method of forming a collapsible ball, comprising the steps of:

providing a plurality of flexible shell sections;

joining said shell sections along at least one joint line to form a spherical body having a central axis and a equatorial plane perpendicular to said central axis, wherein said at least one joint line extends in a plane perpendicular to said equatorial plane;

providing a connector mechanism, having two components being disposed along said central axis, within said spherical body that causes opposing internal areas of said spherical body, to temporarily interconnect when said spherical body is compressed and said spherical body is deformed out of a spherical shape and said opposing internal areas are brought into abutment, wherein said shell sections provide a spring bias that bias said spherical body into said spherical shape.

10. The method according to claim 9, wherein said step of providing a plurality of shell sections include providing a plurality of shell sections that are identical in size and shape.

11. The method according to claim 9, wherein each of said shell sections is formed with at least one slot that extends in a plane perpendicular to said equatorial plane.

12. The method according to claim 9, wherein said step of providing a plurality of shell sections includes providing two generally hemispherical shell sections.

13. The method according to claim 9, further including the step of providing end hubs that support said connector mechanism within said spherical body.

14. The method according to claim 13, wherein said step of joining said shell sections along at least one joint line includes engaging each of said shell sections with said end hubs, wherein said end hubs hold said shell sections in an orientation to form said spherical body.

15. The method according to claim 9, wherein each of said shell sections is a single piece of molded plastic.

16. A collapsible ball assembly, comprising:

a shell having a center axis that can be selectively configured between a spherical shape and a disc shape, said shell being comprised of end hubs and a plurality of shell sections joined together by said end hubs, wherein said plurality of shell sections meet along joint lines that are coplanar with said center axis, and wherein said plurality of shell sections provide a spring bias that bias said shell into said spherical shape;

a connection mechanism coupled to said end hubs that retains said shell in said disc shape against said spring bias of said plurality of shell sections for a period of time after said shell is compressed from said spherical shape into said disc shape.

17. The collapsible ball assembly according to claim 16, wherein each of said plurality of shell sections are identical in size and shape.

18. The collapsible ball assembly according to claim 16, wherein said plurality of shell sections includes two hemispherical shell sections.

19. The collapsible ball assembly according to claim 16, further including depressions formed in said plurality of shell sections to assist said plurality of shell sections to bend without creasing.

* * * * *